US009792818B2

(12) United States Patent
Aggarwal et al.

(10) Patent No.: US 9,792,818 B2
(45) Date of Patent: Oct. 17, 2017

(54) CENTRALIZED PARKING PAYMENT AND MONITORING SYSTEM USING GEO LOCATION ENABLED DEVICES

(71) Applicant: Sunil Goel, Gandhinagar (IN)

(72) Inventors: Adityakumar Akshaikumar Aggarwal, Shelby Township, MI (US); Sunil Goel, Gandhinagar (IN)

(73) Assignee: Adityakumar Akshaikumar Aggarwal, Detroit, MI (US)

( * ) Notice: Subject to any disclaimer, the term of this patent is extended or adjusted under 35 U.S.C. 154(b) by 114 days.

(21) Appl. No.: 14/423,127

(22) PCT Filed: May 2, 2013

(86) PCT No.: PCT/IN2013/000294

§ 371 (c)(1),
(2) Date: Feb. 21, 2015

(87) PCT Pub. No.: WO2014/033727

PCT Pub. Date: Mar. 6, 2014

(65) Prior Publication Data

US 2015/0213716 A1 Jul. 30, 2015

(30) Foreign Application Priority Data

Aug. 27, 2012 (IN) ..... 2490/MUM/2012

(51) Int. Cl.
*G07B 15/02* (2011.01)
*G08G 1/14* (2006.01)

(52) U.S. Cl.
CPC ..... *G08G 1/144* (2013.01); *G07B 15/02* (2013.01); *G08G 1/146* (2013.01)

(58) Field of Classification Search
CPC .... G07B 15/02; G06Q 20/127; G06Q 20/102; G06Q 20/32

(Continued)

(56) References Cited

U.S. PATENT DOCUMENTS

2002/0032601 A1* 3/2002 Admasu ..... G06Q 30/04 705/13
2002/0143611 A1* 10/2002 Odinak ..... G06Q 20/102 705/13

(Continued)

*Primary Examiner* — Albert Wong

(57) ABSTRACT

The present invention describes the system of centralized parking payment and monitoring, which uses geo-location enabled devices such as iPhone, android, RIM devices, mobile phones, pagers and wireless mobile computers.
Using such system person can get a parking receipt; do payment of parking in the paid parking area directly from his geo-location enabled devices without any intervention of any attendant.
Simultaneously, police or parking manager can also check the virtual parking receipt of the vehicle in the centralized parking system using Geo-location enable mobile device.
The big differences between this new solution is compared to existing solution are (1) [004] All the current solutions are identifying a particular parking spot instead of looking at holistic view of parking on a whole street or an unmanned parking area. Geo-location devices have 5-25 meters inaccuracy in identifying a position i.e. 1-5 parking spots inaccuracy. As a result, geo-location device cannot locate a particular parking spot. Thereby no public parking solution exists based on the geo-location based devices alone. In our solution, we re-engineered the business problem and instead of looking at a particular parking spot, the new process is dependent of parking of particular section of street or an unmanned parking lot—which we refer to 'Parking Area'. The characteristic of Parking Area is that pricing and business apply to Parking Area as a whole unit. We are able to provide solution just based on geo-location based devices by combining concept of Parking Area with design of with parking application along with enforcement application. Parking Area will be divided in three level hierarchy Admin1, Admin2 & Admin3. (2) [005] This solution does not need any new devices to be installed or parking spots to (Continued)

Contextual Diagram be marked and entered in the parking application. It uses geo-location enabled devices to identify the location of the parking place.

9 Claims, 6 Drawing Sheets

(58) Field of Classification Search
USPC ..... 705/13; 340/932.2
See application file for complete search history.

(56) References Cited

U.S. PATENT DOCUMENTS

| | | | | |
|---|---|---|---|---|
| 2004/0068433 | A1* | 4/2004 | Chatterjee | G06Q 20/127 705/13 |
| 2008/0071611 | A1* | 3/2008 | Lovett | G07B 15/02 705/13 |
| 2009/0292597 | A1* | 11/2009 | Schwartz | G06Q 10/10 705/13 |
| 2010/0026522 | A1* | 2/2010 | Ward, II | G06Q 20/127 340/932.2 |
| 2010/0268618 | A1* | 10/2010 | McQuilken | G06Q 20/32 705/26.1 |
| 2010/0274693 | A1* | 10/2010 | Bause | G06Q 20/32 705/32 |
| 2012/0130777 | A1* | 5/2012 | Kaufman | G07B 15/02 705/13 |

* cited by examiner

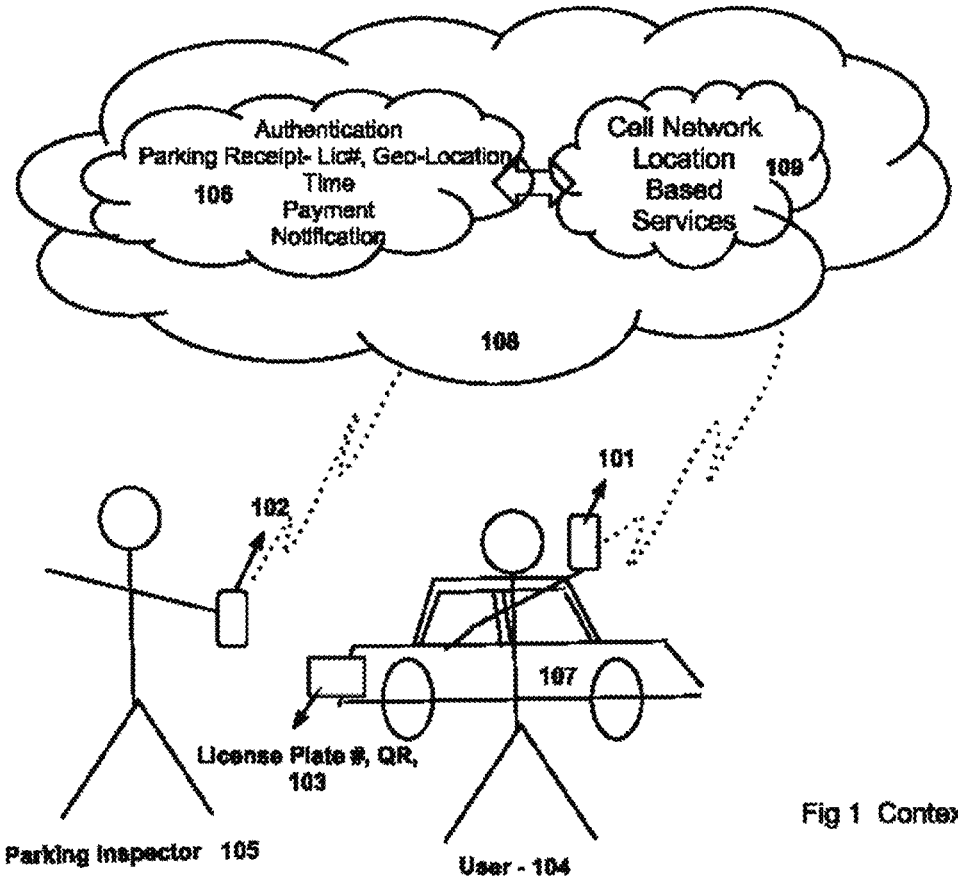
Fig 1 Contextual Diagram

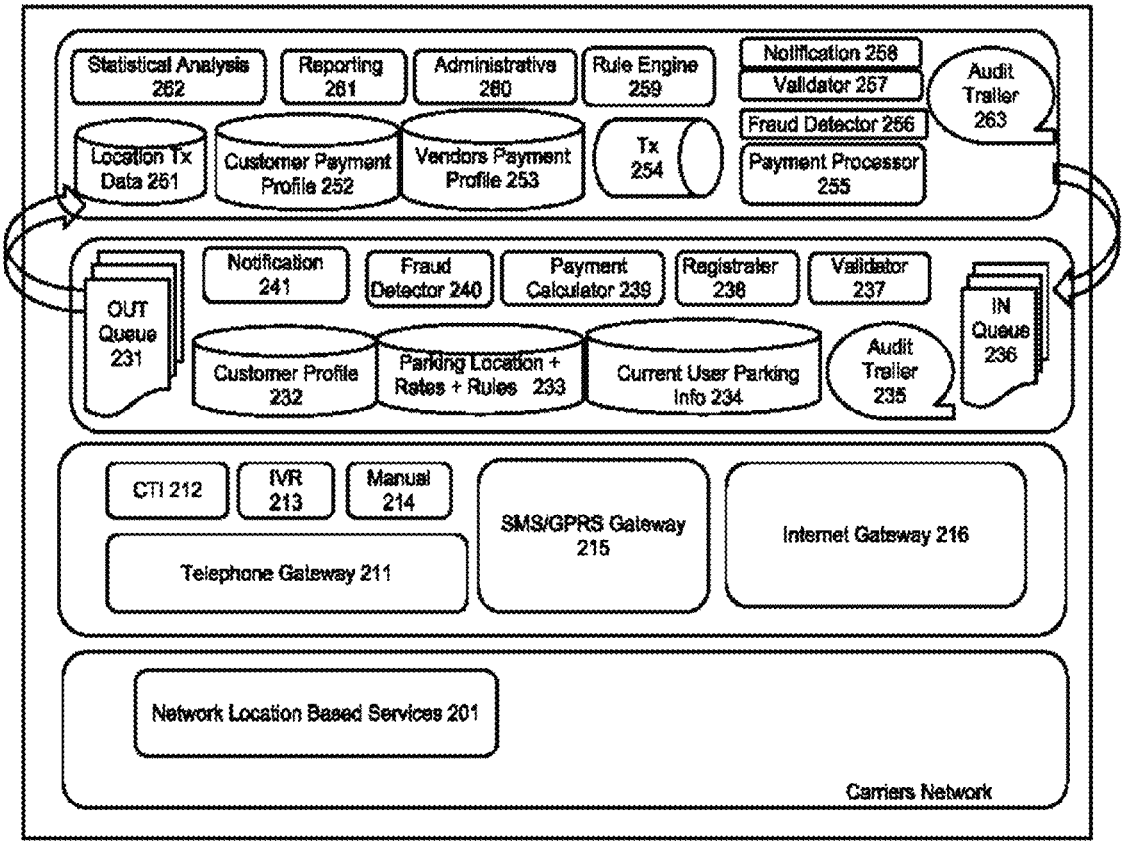
Fig 2 Cloud Parking Block Diagram

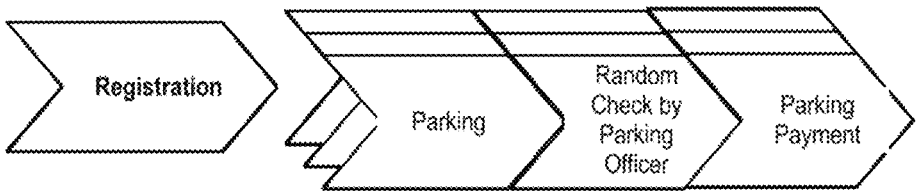
Fig 3 Level 0 Process Diagram

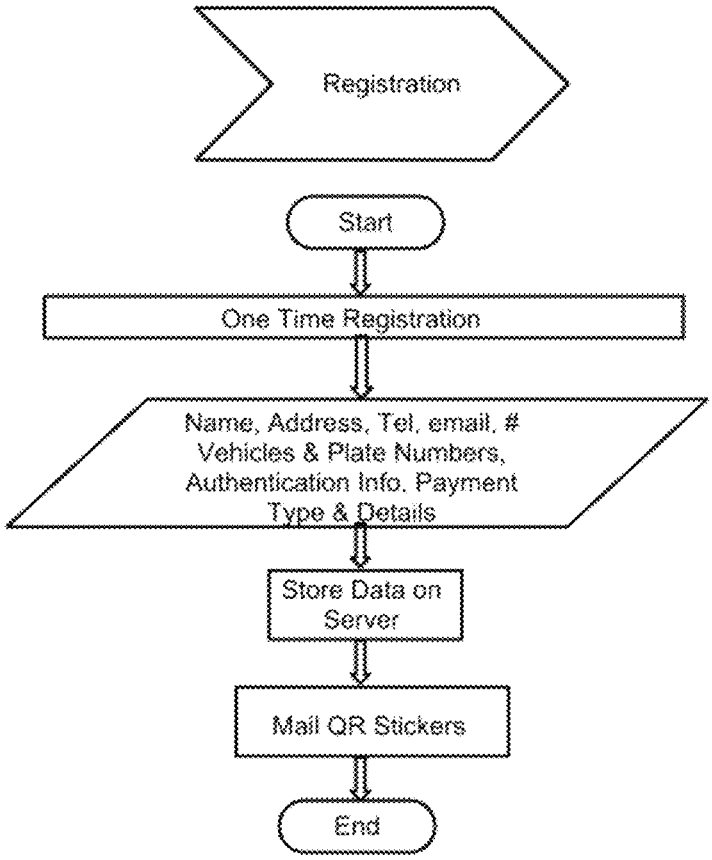
Fig 4 Flow Chart for Registration

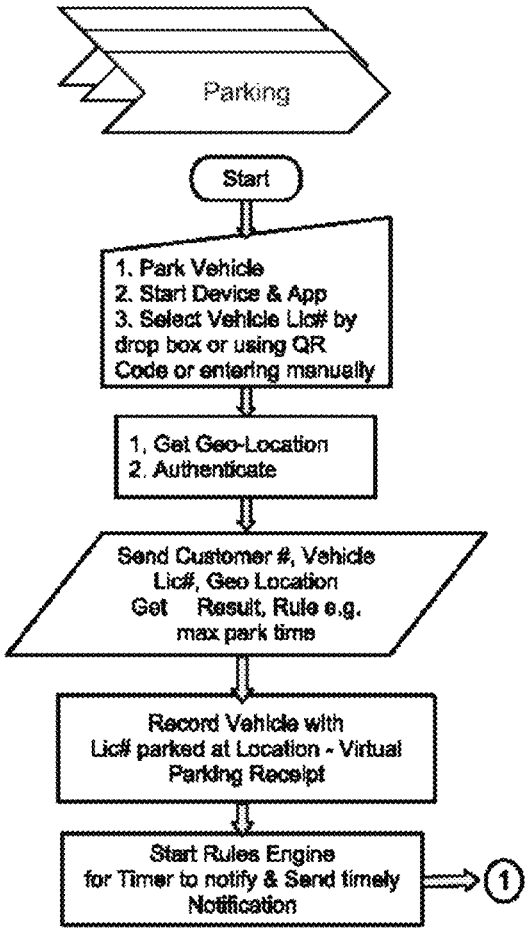
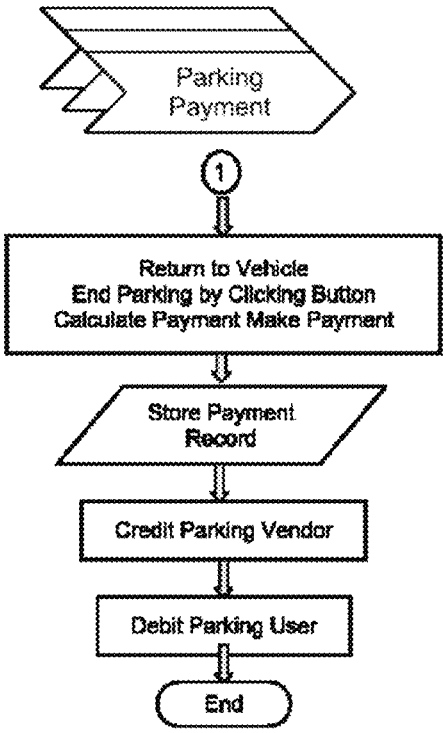
Fig 5 Flow Chart for Registration & Payment

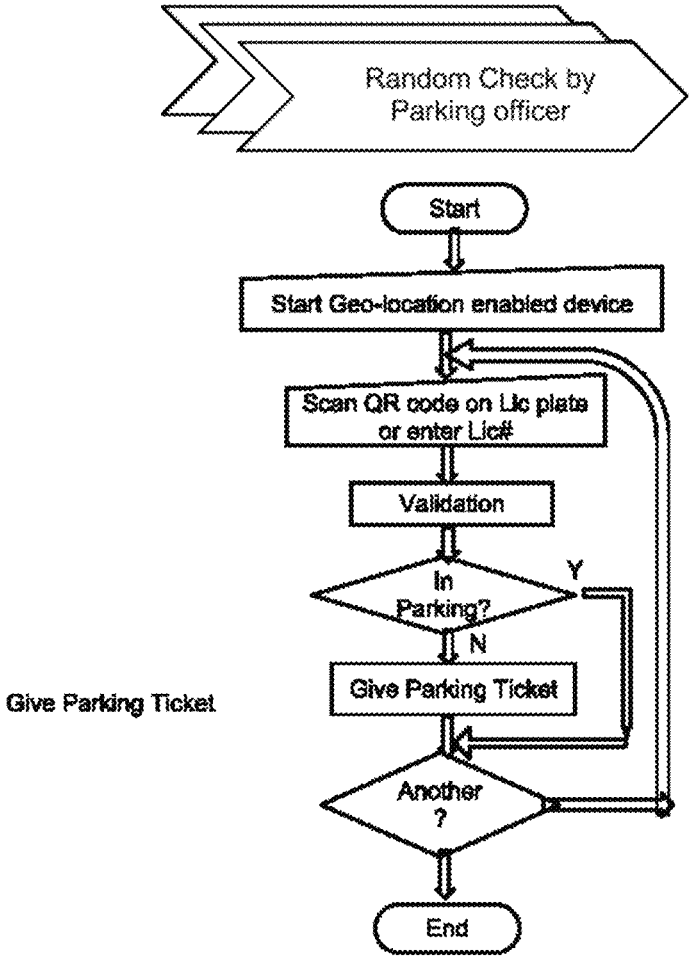
Fig 6 Random Check by Parking enforcement Officer

CENTRALIZED PARKING PAYMENT AND MONITORING SYSTEM USING GEO LOCATION ENABLED DEVICES

FIELD OF INVENTION

The present invention describes a system of centralized parking payment and monitoring, which uses geo-location enabled devices such as iPhones, android phones, RIM devices, mobile phones, pagers and wireless mobile computers.

Using such systems, a person can get a parking receipt; do payment of parking in the paid parking area directly from his geo-location enabled device without any intervention of any attendant.

Simultaneously police or parking manager can also check the virtual parking receipt of the vehicle in the centralized parking system using a Geo-location enabled device.

The big differences between this new solution, as compared with existing solutions are given in [004] and [005].

All the current solutions are identifying a particular parking spot instead of looking at the holistic view of parking on a whole street or an unmanned parking area. Geo-location devices have 5-25 meters' inaccuracy in identifying a position i.e. 1-5 parking spots. As a result, a geo-location device cannot locate a particular parking spot. Therefore, no public parking solution can exist based on the geo-location based devices alone. In our solution, we have re-engineered the business problem and instead of looking at a particular parking spot, the new process is parking on a particular section of a street or an unmanned parking lot—which we refer to as a 'Parking Area'. The characteristic of a Parking Area is that pricing and business-rules apply to the Parking Area, as a whole unit. We are able to provide a solution, just based on geo-location based devices by combining the concept of a Parking Area, with design of the parking application along with enforcement application. A Parking Area will be divided in a three level hierarchy: Admin1, Admin2 & Admin3.

This solution does not need any new devices to be installed or parking spots to be marked and entered in the parking application. It uses geo-location enabled devices to identify the location of the parking place.

BACKGROUND OF INVENTION

This invention relates with the problem of car parking in paid parking areas, especially in the winter or summer season, or when the motorist parking his vehicle is not able to come back again to the vehicle to pay the charges for a further period, especially if he is busy in a business meeting, or if he forgets to pay the required charges, or if he is late to pay a charge for extended time, and has a provision for allowing also the possibility to pay a fine for not paying the car parking charges. To avoid this problem, the present invention provides easier and an effective way for the same for car drivers and owners.

So far some of the inventions which try to resolve the same problem by using different means include [007], [008], [009] and [010].

WO2005031494 illustrate the use of Pager device and system for parking payment charges, wherein a vehicle-portable parking meter device for paying parking charges and for displaying paid parking time comprises a radio-operable two-way pager having a display screen and a contact or contactless storage chip. The pager can be installed in a vehicle so the screen is visible from outside.

KR20090084305 discloses a system and method for payment parking fee using mobile phone and parking machine, wherein a key input unit inputs a park application data including a mobile phone number and a parking time. A memory stores a parking fee of the parking lot and the inputted data through a key input unit, and an accounting unit calculates the parking fee based on the parking time which is inputted through the key input part.

KR20040080781 provides an apparatus and method for levying parking fees using cellular phone payment method, in which a settlement server is connected mobile phone wireless, wherein an entrance control unit issues a parking ticket including information related to an identification number and a telephone number connected to a settlement server and transmits the identification number and the incoming time to the settlement server. The settlement server calculates parking fees, charges the parking fees to a cellular phone, and permits the outgoing of a vehicle. An exit controller recognizes the identification number of the parking ticket and opens a gate of a parking lot.

KR20040070953 provides a method and an apparatus for managing parking by using a mobile phone are provided to effectively use a parking space by allowing a person to park with payment of a suitable charge and automatically operating a parking management, wherein a parking management communication module is installed at every parking section of a parking area. A parking management central server receives parking information transmitted from a plurality of parking management communication modules through a mobile communication network or a private wireless network, integrally manages the information, and settles up a parking fee. A mobile communication server confirms a resident registration number and approves settlement; a parking manager mobile phone or other communication device receives a text message from the parking management central server. A telephone line connects the mobile communication server and the car owner mobile phone with the parking management central server.

Though all above mentioned inventions describes the use of mobile phone or pager like devices to do the payment of parking but either it requires some apparatus to be placed in the parked car or else requires some ticket wending machine in the parking lot. But when car is parked in some open street or in unmanned parking area, such devices may not give practical solution of the payment of parking. Over and above at different location in the city, depending on the congestion of the area, the charges of parking are different and maximum allowable times are also different. In such condition, systems available in prior art do not address the issue.

The present invention deals with providing a system wherein when the user starts the application from his geo-location enabled device like smart phone or laptop or such kind of devices, it will send the message to the centralized server, which will take record of the time of car parked in a particular area and when the user ends the application, the server calculates the total charges of parking fees depending on the rate of parking prevailing in that geo-location. Users can do the payment by mobile or net banking or by credit card, which can be recorded in real time by the centralized server and acknowledgement of the paid receipt will be sent in real time. This invention does not require any special instrument or device to be placed in the parking lot or in the car and hence will reduce the cost of installment and maintenance of such device and also reduce the expenditure on human resources required to monitor the parking lot.

OBJECTIVES OF THE INVENTION

The main objective the present invention is to provide a system for centralized payment of parking using geo-location enabled devices in such a way that accurate calculation and payment of parking fees can be done even when the parking is done in an open street or in an unmanned area.

Another objective is to provide an effective means to the police or the parking manager of a parking area, to monitor and track the payment done by the user.

Another objective is to replace the use of parking meters and thereby reduce the cost required for new installation and maintenance of thousands of parking meters.

Yet another objective is to provide easy transaction of the payment by the users and to reduce the work of parking regulating authority for collecting money (coins) from each of the parking places.

Another objective is to provide convenience to end user to pay for parking without searching for coins and also estimating what is the right amount of parking time; as sometimes meetings are completed in a few minutes and sometimes these may last much longer.

Lastly the system aims to provide location based services to the driver.

SUMMARY OF INVENTION

Thus according to one aspect of the present invention, there is provided a system for centralized payment of parking using geo-location enabled devices in such a way that accurate calculation and payment of parking fees can be done even when the parking is done in an open street or in an unmanned area.

According to another aspect of the present invention, there is provided a method of online payment for parking areas using a centralized server based system.

According to a further aspect of the present invention, there is provided a system for police or parking manager to check whether payment has been done by a user or not.

According to another aspect of the present invention, there is provided a system which can use the record of a customer's profile along with the details of his vehicles, which can be useful for tracing the record of any suspected vehicle.

According to another aspect of the present invention, there is provided a system which can use Optical Character Recognition (OCR) in the backend to decrypt the photo of the vehicle number plate to recognize the vehicle.

According to a further aspect of the present invention, there is provided a system which can alternatively uses barcode to identify the vehicle, wherein customers who enrol in the program get a free barcode for each vehicle they have registered.

According to a further aspect of the present invention, there is provided a system through which location of the vehicle is verified by knowing the location of the Parking Enforcement Officer's phone.

BRIEF DESCRIPTION OF THE INVENTION

The present invention provides a centralized parking payment and monitoring system using geo-location enabled devices.

Some preferred forms of the invention are shown in the drawings in which

FIG. 1 represents the contextual diagram of the present invented system

FIG. 2 represents the block diagram of the present invented system

FIGS. 3, 4, 5 and 6 represents the flow diagrams of the invented system.

DETAILED DESCRIPTION

There are four major components as shown in FIG. 1 (a) A geo-location enabled device (101) owned by the user (104), who is parking the vehicle (107); (b) A geo-location enabled device (102) used by the Parking Enforcement Officer (105); (c) Cloud based parking system (106) to keep track of virtual parking receipts, for issuing parking violation tickets and for performing parking payment transactions and (d) Cell network which includes Location Based Services (LBS)(109).

FIG. 1. shows the contextual diagram of the operation where a person (104) parks the vehicle (107) and uses his geo-location enabled device (101) to inform the cloud-based parking system (106) about the parking so that it creates virtual parking receipt. The location is provided by the GPS in the device or by the Location based service provided by carrier network. There can be various parking plans such as hourly prepaid, all day/week/month pre-paid pass, or pay at the end for number of hours/minutes parked. The different parking plans are not limited to what is described but can support multiple plans and their combination as complex rules can be built in the rule engine (252).

Police or Parking Enforcement Officer (105) uses the other application on the geo-location enabled device (102) as shown in FIG. 1 to check the Vehicle License Plate number or barcode (103) to check the virtual parking receipt in the centralized cloud. This whole design doesn't need parking meter or sensors or other equipment or any other marking at the parking location for the system to work thereby reducing the infrastructure implementation and maintenance costs.

The process is described in more detail using FIG. 2, FIG. 3, FIG. 4, FIG. 5 and FIG. 6.

User downloads the Application on their geo-enabled device and installs and configures it as one time registration process as shown in FIG. 3, under registration chevron by providing Name, Address, vehicle licence(s) number, Authentication information and method of payment type and other payment details. Registration is one time operation and is done using User Interface (201). Alternative can be provided where one time registration can be performed using web application though computer (216) and then mobile app is configured with the user authentication credentials. A user can enter multiple vehicle licence numbers at one time and also define the default vehicle. Or a user can also register by calling on the phone using the services of a live operator or by using an Interactive Voice Recognition (IVR) (213) system or by using Computer Telephone Interactive (CTI) (214) application or by sending a SMS/GPRS message (215).

The profile of a user is kept on the central server along with payment method, vehicle numbers and user address (232). This prevents loss of information if the user's phone is lost or it stops working or the app is to be installed on any other devices. The default vehicle can be specified for a particular geo-location device. This functionality is useful in case, where users can share the same parking account in their family and each family member can have a different default license plate for their vehicle. The basic user profile information is stored in Customer Profile (232), while more financial sensitive information is stored in Customer Payment Profile (252). Customer authentication information can be stored in the device in encrypted form using security library (206). A Quick Response (QR) sticker can be provided for placing it on the vehicle (107). This QR code (103) can be scanned using the camera fitted in the parking lot and can be used by the user or the Parking Officer to identify the parked vehicle, thereby eliminating the need for entering the vehicle number manually. The other option is to use image recognition by taking the picture of the License plate number. The information is shared with the cloud-based parking system using WiFi or Wireless data network (108).

As shown in FIG. 4, the parking process starts with a user parking the vehicle in the parking place and starting the application which logs into the cloud-based parking system (106) to get the virtual parking receipt by providing License Plate number. The entry can be most easily done by the user by using the User Interface on device or sending SMS message or calling the phone number using mobile device. The user can override the default vehicle number and select parking options based on the location or conditions specified by the parking company. In case the user has a geo-location enabled device like wireless-laptop, they can use web application to start parking (216).

If geo-location enabled devices don't have local GPS, they use network based location based services (201). Some smart phones augment the accuracy of the GPS by using network based location services (201). A user having geo-location enabled simple mobile phones, parks their vehicle at the appropriate parking space and uses normal cell phone to call a specified number. The Computer Telephone Interface (CTI) (213) and Interactive Voice Response (IVR) (214) applications in the cloud-based system responds back and uses location based services from the cellular network service provider to locate the user.

The application can be started by clicking Start button or by voice command to inform the cloud-based system about parking of the vehicle. As the cloud already has License Plate number stored during the registration process in the system, the user does not need to re-enter the same.

In another embodiment of the present invention, if the vehicle is new or rental or a borrowed one, the user can overwrite the default by entering the new vehicle license plate number.

Still in another embodiment of the present invention, the information about the location can be sent by SMS message to SMS gateway (215) connected to the cloud-based parking system. The SMS message includes the details like user identification number, vehicle license plate number and starting command for parking.

Yet in another embodiment of the present invention, there is provided an alternative for non registered users, wherein a user can go online through internet or may call to the toll free number and provides location details along with timing.

Still in another embodiment of the present invention, there are provided multiple payment plans duly supported by the centralized cloud-based system, which include pre-pay for a fixed time, pay at the end of parking based on actual parking time or even a whole day parking pass. Also notification can be provided from the cloud parking system by sub-systems (241) and (258).

Yet in another embodiment of the present invention, the parking application sends notification to the user when he/she is going over the parking limits or the parking lot is going to close.

Still in another embodiment of the present invention, when the geo-location enabled devices are not notification enabled then the system can notify by calling on the user's phone or by sending an SMS/GPRS message based on user preferences.

A User, on returning to the vehicle, stops the parking application on the geo-location enabled device using User Interface as depicted by workflow under 'Parking Payment' in FIG. 5.

Yet in another embodiment of the present invention, the user who has geo-location enabled simple mobile phone can dial the toll free phone number using their cell phone. The CTI and IVR enabled cloud-based parking system takes the call and based on the options selected, it would end the parking.

Still in another embodiment of the present invention, the user can send a SMS cryptic message to SMS gateway connected to the cloud parking system. The SMS cryptic messages could be password-protected, and end parking command using cell phone.

Yet in another embodiment of the present invention, the payment will be calculated (239) for the parking and credited using set of systems (252, 253, 254, 255 and 259) to the parking authority based on the financial agreement signed. The system calculates the amount of money to be paid and shows to the user and charges it to his/her credit card or other payment method as specified in the profile and credits that amount to the party owning the parking area, after subtracting agreed upon service charge.

In another embodiment of the present invention, there is provided the cloud-based parking system which completes the parking transaction by debiting the user account by an amount equal to the parking charges and credits the parking entity's account according to the business agreement.

Still in another embodiment of the present invention, there is provided the fraud prevention system (240 and 256) to reduce the frauds committed.

Yet in another embodiment of the present invention, there is provided a system wherein if a user forgets to click complete parking and drives away, then the application will send notification to the user based on the amount of distance they are away from the active parked location and speed of the person carrying the smart phone is moving.

Still in another embodiment of the present invention, wherein the parking enforcement officer uses a enforcement application to verify if the vehicle has a parking receipt as depicted in FIG. 6 under the Chevron 'Random Check by Parking Officer'. The officer uses the camera to read QR code to identify the vehicle or they can enter the License Plate number or take a photo of the license Plate number which is then OCR to be recognized.

Yet in another embodiment of the present invention, wherein the enforcement officer can check for parking violation in running the enforcement application on the smart phone or in their geo-location enabled devices like laptop, palmtop or any other device and enters the vehicle number to check if the vehicle has any violation.

Still in another embodiment of the present invention, wherein the enforcement application can show the vehicles parked near the location, where the enforcement officer is standing, using the geo-location of their co-ordinates.

Yet in another embodiment of the present invention, wherein the Parking Enforcement Officers having simple geo-enabled mobile phone can check whether the vehicle parking is being paid or time is up by calling the phone number of the parking cloud service and entering the their personal password, vehicle license number, the CTI (212) and IVR (213) enabled parking enforcement application running on cloud will provide the answer.

Still in another embodiment of the present invention, wherein the other option is to send a SMS cryptic message to SMS gateway connected to the cloud parking system. The SMS cryptic messages could be password, vehicle license plate number and validate parking command using cell phone. The cloud responds by SMS message where that vehicle has virtual parking payment receipt.

Yet in another embodiment of the present invention, wherein if there is a parking violation, then Enforcement Officer can generate a ticket using ticket functionality available in the centralized cloud system and send it to the user's geo-enabled device.

Still in another embodiment of the present invention, wherein ticket can also be printed by officer using portable printer or can be manually written and put on parked vehicle.

Yet in another embodiment of the present invention, wherein the said system can work with multiple parking authorities or companies as it can identify the parking location due to location information provided by the smart phone or above mentioned geo-location enabled devices. Also, it can enforce different rules and parking rates based on the parking lot or place it is parked on.

Still in another embodiment of the present invention, wherein the said system can identify the geo-location of the particular vehicle when parked in the particular Parking Area.

Yet in another embodiment of the present invention, the system provides the set rules for parking and its payment rate depending on particular geo location of Parking Area. To do so, the system provides three types of admin instructions to identify parking areas like:

(a) Admin-1—Texture Representation—Name of County/District/State
(b) Admin-2—Texture Representation—City/Administrative Area
(c) Admin-3—Latitude, Longitude co-ordinates of the polygon representing the place. Also, define the rectangle Latitude, Longitude co-ordinate surrounding the polygon for quick filtering out When the vehicle is parked and the system is started, initially it will search for Admin-3 to identify the set rules for said location using the data received from the location based services. If it cannot find any Parking Area linked with Admin-3, it will search for Admin-2 or Admin-1 using data received from reverse geo-location service call.

In brief, the present invention provides a most convenient way of payment and monitoring of parking by using the system on smart phone or any other geo-location enabled devices like pager, laptop, palmtop or others, particularly in open street or unmanned parking area. The design doesn't require any new infrastructure to be created or marked on the road. This will save time and money both from user side and regulatory agency side.

Although the preferred embodiment as well as the preparation and use have been specifically described, it should be understood that variations in the preferred embodiment could be achieved by a person skilled in the art without departing from the spirit of the invention. The invention has been described with reference to specific embodiments which are merely illustrative and not intended to limit the scope of the invention as defined in the claims.

We claim:

1. A centralized parking and enforcement system for a plurality of parking areas, comprising:

a cloud based server storing: a plurality of parking areas and their geolocations wherein each area comprises a plurality of parking spaces, rules and fees corresponding to each parking area, and account information of users of the system;

one or more user devices, each having a processor, memory, display, and a location determining component wherein each device is adapted to run an app to allow the user to interact with the app to initiate a parking session by sending the current location of the device and identification information of the user to the cloud based server to initiate a timer on the server to begin the parking session, and to receive fee information from the cloud based server based on the parking area determined by the server, and to terminate the timer and the parking session upon further interaction with the app;

an enforcement officer's device having a memory, processor, display and location determining component wherein the officer's device is adapted to send the current location of the officer's device to the cloud based server and to receive and display information on validly parked vehicles in the current location of the officer's device and to send to the cloud based server a parking violation ticket if the officer determines that observed parked vehicles are not validly parked; and a cellular network for providing communications between the cloud based server, the user devices and the officer's device, wherein the server determines the parking area of the user's vehicle based on the received current location of the user's device and sets the user's vehicle status as validly parked when the user initiates the timer, and determines the fee due upon termination of the user's parking session and wherein the user device is adapted to remind the user to terminate a parking session if a parking session is initiated and the user's device determines that its current location has changed and the user's device is moving above a certain speed.

2. The centralized parking and enforcement system of claim 1, wherein the user's device is a pager, a cell phone, a smart phone, a palmtop-like device, or a laptop computer.

3. The centralized parking and enforcement system of claim 1, wherein the location determining component is a GPS system, a location determination system based on cellular signals or a combination of the GPS and the location determination system.

4. The centralized parking and enforcement system of claim 1, wherein the account information of the users includes: master account information, family member sub-accounts, a default license plate, and temporary vehicle information.

5. The centralized parking and enforcement system of claim 1, wherein the parking areas covers different cities, states, and countries and each parking area be owned by different entities.

6. The centralized parking and enforcement system of claim 1, wherein the server may identify unexpected activities in a parking area based on historical data and sends an alert message to the officer or user of the parking area.

7. The centralized parking and enforcement system of claim 1, wherein the server detects an occurrence of fraud in a user's account and notifies the user.

8. The centralized parking and enforcement system of claim 1, wherein the server keeps track of: validly parked vehicles, the parking fees, payments for parking, parking violations, or available parking spaces.

9. The centralized parking and enforcement system of claim 2, wherein the vehicle information is entered into the officer's device by: bar code, QR code, camera, or optical recognition device.

* * * * *